US008937427B2

(12) United States Patent
Quitmeyer

(10) Patent No.: US 8,937,427 B2
(45) Date of Patent: Jan. 20, 2015

(54) SPARK PLUG AND METHOD OF MANUFACTURING THE SAME

(71) Applicant: Federal-Mogul Ignition Company, Southfield, MI (US)

(72) Inventor: Frederick J. Quitmeyer, Rochester Hills, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 14/206,121

(22) Filed: Mar. 12, 2014

(65) Prior Publication Data

US 2014/0265815 A1 Sep. 18, 2014

Related U.S. Application Data

(60) Provisional application No. 61/782,738, filed on Mar. 14, 2013.

(51) Int. Cl.
*H01T 13/20* (2006.01)
*H01T 13/32* (2006.01)

(52) U.S. Cl.
CPC ..... *H01T 13/32* (2013.01); *H01Y 21/02* (2013.01)
USPC ..... 313/141; 313/140

(58) Field of Classification Search
USPC ..... 313/140–142
See application file for complete search history.

(56) References Cited

U.S. PATENT DOCUMENTS

| | | | | |
|---|---|---|---|---|
| 6,094,000 | A * | 7/2000 | Osamura et al. | 313/141 |
| 6,307,307 | B1 | 10/2001 | Kanao | |
| 6,326,719 | B1 | 12/2001 | Boehler et al. | |
| 6,373,172 | B1 | 4/2002 | Kanao et al. | |
| 6,406,345 | B2 | 6/2002 | Boehler et al. | |
| 7,011,560 | B2 | 3/2006 | Downs et al. | |
| 7,190,106 | B2 | 3/2007 | Downs et al. | |
| 7,305,954 | B2 | 12/2007 | Hagiwara et al. | |
| 7,328,677 | B2 | 2/2008 | Hagiwara et al. | |
| 7,808,166 | B2 | 10/2010 | Takeuchi et al. | |
| 7,827,954 | B2 | 11/2010 | Nagasawa et al. | |
| 7,959,482 | B2 | 6/2011 | Nakamura et al. | |
| 8,047,172 | B2 | 11/2011 | Nakamura et al. | |
| 8,082,897 | B2 | 12/2011 | Kato et al. | |
| 8,257,127 | B2 | 9/2012 | Nakamura et al. | |
| 2002/0063504 | A1 * | 5/2002 | Hori | 313/141 |
| 2006/0082276 | A1 | 4/2006 | Havard et al. | |
| 2009/0227168 | A1 | 9/2009 | Nakamura et al. | |
| 2012/0176020 | A1 | 7/2012 | Quitmeyer | |
| 2012/0184171 | A1 | 7/2012 | Nakamura et al. | |

* cited by examiner

*Primary Examiner* — Mary Ellen Bowman
(74) *Attorney, Agent, or Firm* — Reising Ethington P.C.

(57) ABSTRACT

A method of manufacturing a spark plug that includes a metallic shell, an insulator, a center electrode, a ground electrode, and a firing pad. The method may include the steps of: applying a first laser beam to attach the firing pad to the ground electrode, and then using a second laser beam from the same laser beam welder to attach the ground electrode to the metallic shell. The laser beam welder may include a high energy density fiber laser for forming key-hole laser welds, as well as a programmable focusing optic (PFO) assembly for redirecting laser beams from one welding site to the other.

20 Claims, 2 Drawing Sheets

SPARK PLUG AND METHOD OF MANUFACTURING THE SAME

REFERENCE TO RELATED APPLICATIONS

This application claims the benefit of U.S. Provisional Ser. No. 61/782,738 filed on Mar. 14, 2013, the entire contents of which are incorporated herein.

TECHNICAL FIELD

This disclosure generally relates to spark plugs and other ignition devices for internal combustion engines and, in particular, to assembling and attaching spark plug components together.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that causes the power stroke of the engine. The high temperatures, high electrical voltages, rapid repetition of combustion reactions, and the presence of corrosive materials in the combustion gases can create a harsh environment in which the spark plug functions. This harsh environment can contribute to erosion and corrosion of the electrodes and can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip of the electrodes where a spark jumps across a spark gap.

SUMMARY

According to one embodiment, there is provided a method of manufacturing a spark plug. The method may comprise the steps of: providing a firing pad, a ground electrode, and a metallic shell; directing a first laser beam from a laser beam welder to a first welding site that is at or near an interface between the firing pad and the ground electrode and attaching the firing pad to the ground electrode with a first laser weld; and directing a second beam from the laser beam welder to a second welding site that is at or near an interface between the ground electrode and the metallic shell and attaching the ground electrode to the metallic shell with a second laser weld. The first laser beam and the second laser beam can both be emitted using the same laser beam welder.

According to another embodiment, a spark plug includes a metallic shell, an insulator, a center electrode, a ground electrode, and a firing pad. The ground electrode is attached to the metallic shell. The firing pad is comprised of a precious metal material and is attached to the ground electrode. The attachment between the firing pad and ground electrode involves a first key-hole weld, and the attachment between the ground electrode and the metallic shell involves a second key-hole weld.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The assembly and manufacturing processes set forth in this description can be used in spark plugs and other ignition devices including industrial plugs, aviation igniters, or any other device that is used to ignite an air/fuel mixture in an engine. This includes spark plugs used in automotive internal combustion engines like engines equipped to provide gasoline direct injection (GDI), engines operating under lean burning strategies, engines operating under fuel efficient strategies, engines operating under reduced emission strategies, or a combination of these. The manufacturing method described herein may result in strengthened attachment and enhanced thermal management between components of spark plugs, and is an effective and efficient laser welding procedure for attaching or joining spark plug components, among other possible improvements. As used herein, the terms axial, radial, and circumferential describe directions with respect to the generally cylindrical shape of the spark plug of FIG. 1 and refer to a center axis A of the spark plug, unless otherwise specified.

Figure 1:
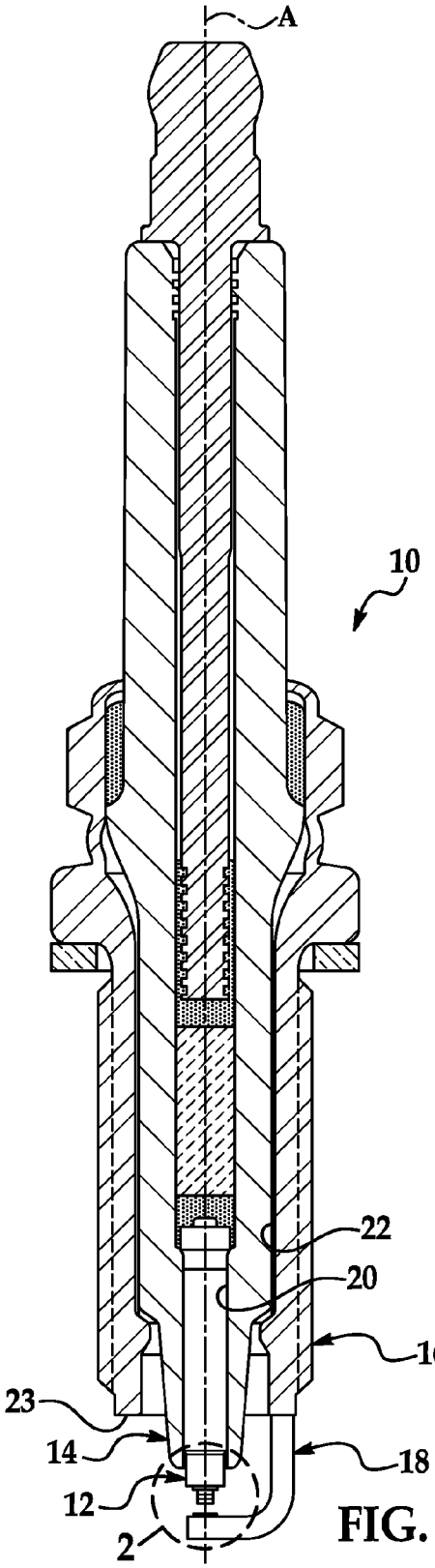
FIG. 1 is a sectional view of an exemplary spark plug.

Referring to FIG. 1, a spark plug 10 includes a center electrode (CE) base or body 12, an insulator 14, a metallic shell 16, and a ground electrode (GE) base or body 18. Other components can include a terminal stud, an internal resistor, various gaskets, and internal seals, all of which are known to those skilled in the art. The CE body 12 is generally disposed within an axial bore 20 of the insulator 14, and has an end portion exposed outside of the insulator at a firing end of the spark plug 10. In one example, the CE body 12 is made of a nickel (Ni) alloy material that serves as an external or cladding portion of the body, and includes a copper (Cu) or Cu alloy material that serves as an internal core of the body; other materials and configurations are possible including a non-cored body of a single material. The insulator 14 is generally disposed within an axial bore 22 of the metallic shell 16, and has an end nose portion exposed outside of the shell at the firing end of the spark plug 10. The insulator 14 is made of a material, such as a ceramic material, that electrically insulates the CE body 12 from the metallic shell 16. The metallic shell 16 provides an outer structure of the spark plug 10, and has threads for installation in the accompanying engine. The metallic shell 16 can be composed of a steel alloy or any other suitable material, and it may also be coated with a zinc-based or nickel-based alloy coating, for example.

Figure 2:
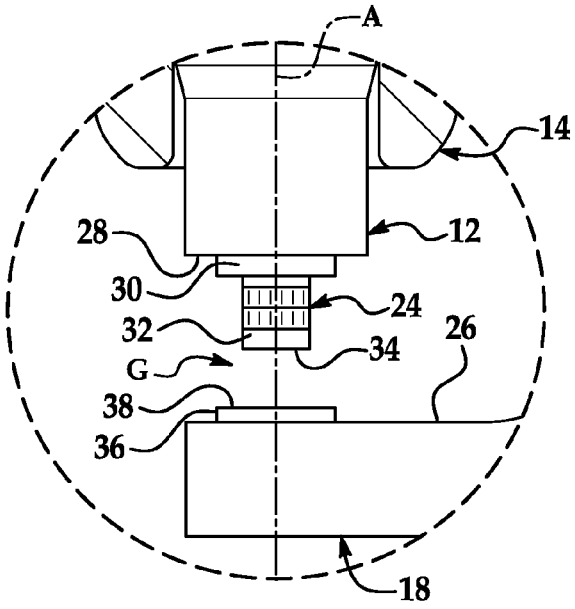
FIG. 2 is an enlarged view of a firing end of the spark plug of FIG. 1.

Referring now to FIGS. 1 and 2, the GE body 18 is attached to a free end 23 of the metallic shell 16 and, as a finished product, may have a generally L-shape. At an end portion nearest a spark gap G, the GE body 18 is axially spaced from the CE body 12 and from a CE firing tip 24 (if one is provided). Like the CE body 12, the GE body 18 may be made of a Ni alloy material that serves as an external or cladding portion of the body, and can include a Cu or Cu alloy material that serves as an internal core of the body; other examples are possible including non-cored bodies of a single material. Some non-limiting examples of Ni alloy materials that may be used with the CE body 12, GE body 18, or both, include an alloy composed of one or more of Ni, chromium (Cr), iron (Fe), manganese (Mn), silicon (Si), or another element; and more specific examples include materials commonly known as Inconel® alloy 600 or 601. In cross-sectional profile, the GE body 18 can have a generally rectangular shape or some other suitable profile. The GE body 18 has an inner or axially-facing working surface 26 that generally confronts and opposes the CE body 12 and/or the CE firing tip 24 across the spark gap G.

As mentioned, in the embodiment depicted in the figures, the spark plug 10 includes the optional CE firing tip 24 that is attached to an axially-facing working surface 28 of the CE body 12 and exchanges sparks across the spark gap G. Referring particularly to FIG. 2, the CE firing tip 24 shown here has a two-piece and generally rivet-like construction and includes a first piece 30 (rivet head) welded to a second piece 32 (rivet stem). The first piece 30 may be directly attached to the CE body 12, and the second piece 32 may be directly attached to the first piece so that an axially-facing sparking surface 34 is provided for exchanging sparks across the spark gap G. The first piece 30 can be made of a Ni-alloy material, and the second piece 32 can be made of a noble metal-alloy material such as those including iridium (Ir), platinum (Pt), or ruthenium (Ru); other materials for both of these pieces are possible. In other embodiments not shown in the drawings, for example, a separate or discrete CE firing tip is omitted altogether, in which case sparks are exchanged from the CE body 12 itself. The optional firing tip 24 could have a one-piece or single-material construction and it could have different shapes including non-rivet-like shapes such as cylinders, bars, columns, wires, balls, mounds, cones, flat pads, rings, or sleeves, to cite several possibilities. The present spark plug and manufacturing method are not limited to any particular CE firing tip or firing end arrangement.

Referring again to both FIGS. 1 and 2, the spark plug 10 further includes a firing pad 36 made of a precious metal material and attached to the working surface 26 of the GE body 18 for exchanging sparks across the spark gap G. The firing pad 36 is provided as a thin pad in the sense that its greatest width dimension across a sparking surface 38 is several times or more larger than its greatest axial thickness dimension through the firing pad, although not necessarily. According to a non-limiting example, the firing pad 36 has a thickness that is less than or equal to about 0.275 mm or, more preferably, between approximately 0.05 mm and 0.2 mm (e.g., a thickness of about 0.13 mm). This thin pad embodiment is different than many previously-known firing tip configurations with so-called fine wire constructions in which the greatest width dimension across the sparking surface of the wire (i.e., the diameter) is less than the thickness dimension of the wire (i.e., the axial height). As mentioned, the firing pad 36 is preferably made from a precious metal material, and can be made from a pure precious metal or a precious metal alloy such as those containing Pt, Ir, Ru, or a combination thereof. In some non-limiting examples, the firing pad 36 is made from a Pt alloy containing between approximately 10 wt % and 30 wt % Ni or Ir and the balance being Pt, or one containing between approximately 1 wt % and 10 wt % tungsten (W) and the balance being Pt; in either of the preceding Pt-alloy examples, other materials like Ir, Ru, rhodium (Rh), rhenium (Re), or a combination thereof could also be included. Other materials are possible for the firing pad 36, including pure Pt, pure Ir, pure Ru, to name a few. The present spark plug and manufacturing method are not limited to any particular precious metal or other material composition.

The attachments between the GE body 18 and the metallic shell 16 and between the GE body and the firing pad 36, as set forth in this description, are made in a more effective and efficient way than in the past. In previously-known attachment procedures, an attachment made between a GE body and a shell was performed in a dedicated procedure with dedicated equipment, while an attachment made between the GE body and a GE tip was performed in yet another discrete and dedicated procedure with its own dedicated equipment and typically at another working station. Usually, these procedures involved resistance welding, especially the GE body and shell attachment. If laser welding was performed in the previously-known procedures, it was often only performed between the GE body and tip—and again while using discrete and dedicated procedures and equipment.

The manufacturing method or attachment process described here, in contrast, may utilize a single laser welding apparatus to attach the firing pad 36 to the GE body 18 and the GE body 18 to the metallic shell 16, and does so with minimal steps. The exact attachment process can vary in different embodiments, including the performance of more, less, or dissimilar steps than those shown and described. Indeed, the exact process may be dependent upon, among other factors, the design and construction of the spark plug 10 and the equipment being employed. The embodiment of FIG. 3 involves laser beam welding and is one process in a larger spark plug assembly and manufacturing operation. In particular, a laser beam welder 40 and its delivery head 42 may be used to emit a first laser beam L that attaches the firing pad 36 to the GE body 18 at or near a first welding site 46, and to emit a second laser beam L' that attaches the GE body 18 to the metallic shell 16 at or near a second welding site 50. First and second laser welds can be formed sequentially at the first and second welding sites 46, 50 during separate and distinct laser welding steps—that is, one of the welds is created and then the other weld is created at a different time, such as immediately following the first weld. In the example described below, the firing pad 36 is initially attached to the GE body 18, and then the GE body 18 is attached to the metallic shell 16; but in other examples, the order can be reversed and the GE body and metallic shell can be attached first, followed by attachment of the firing pad to the GE body.

Whatever the order, different combinations of parts and components can be moved or can remain stationary. For instance, the welder 40, the delivery head 42, and the spark plug 10 can be fixed and static during both of the first and second laser beam welds, while only the laser beam L itself is deflected and aimed at the different weld sites of the spark plug. In one specific example, focusing optic functionality is employed in which a programmable focusing optic (PFO) assembly 44 can utilize mirrors or other reflective surfaces to deflect and direct the laser beams L, L', while all of the welder 40, delivery head 42, and spark plug 10 remain stationary. In general, the PFO assembly 44 can aim the laser beams L, L' at a predetermined target and can guide the laser beam along a predetermined path. One specific example of a PFO assembly is supplied by TRUMPF, Inc. of Farmington, Conn. U.S.A. and is sold under the product name "PFO 20." Of course, other examples of PFO assemblies are possible, including ones supplied by other companies. In a different embodiment, one or more of the welder 40, the delivery head 42, or the spark plug 10 can be rotated, brought together, brought apart, or otherwise moved during the first, second, or both laser beam welds. Of course, in other embodiments other techniques and assemblies can be used to furnish the first and second laser beam welds to the different weld sites, including functionality that does not necessarily involve focusing optics. In some cases, existing laser welders can be retrofitted with equipment needed to carry out the present method. It is possible for the method to be performed at a single working station, and it is possible for the method to involve automated and robotic operations, to cite several possibilities.

Figure 3:
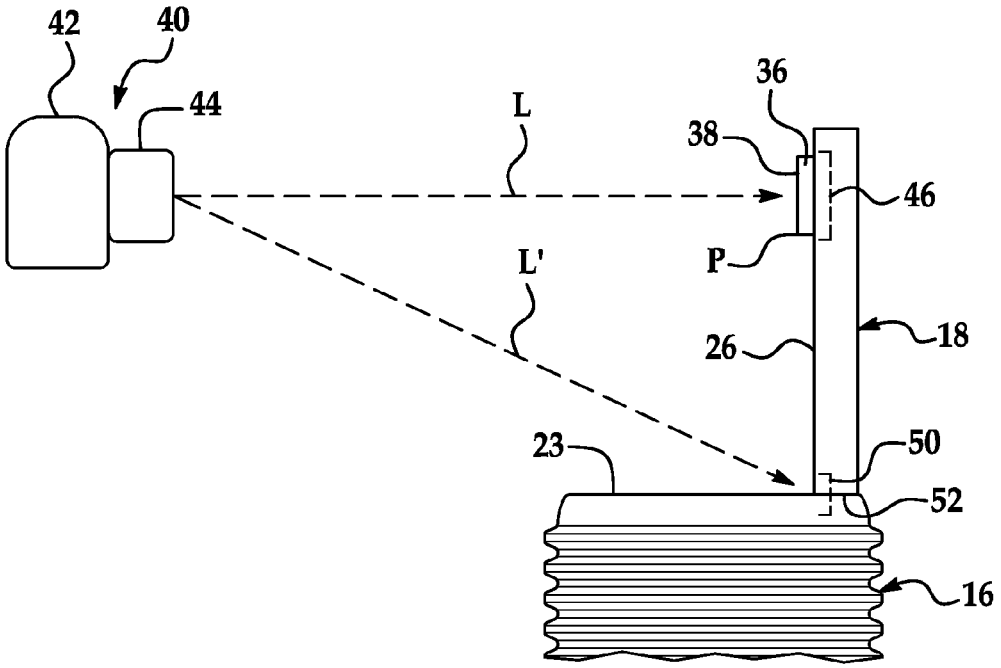
FIG. 3 is a diagrammatic view of an exemplary laser beam welding process.
Figure 4:
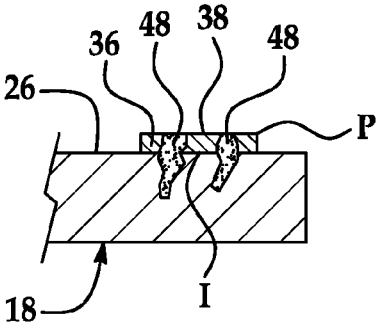
FIG. 4 is a sectional view of an exemplary attachment between a ground electrode body and a firing pad, and is rotated with respect to FIG. 3.

Using the PFO assembly 44 to perform the first laser beam weld in this embodiment, the laser beam L is emitted in a first direction generally at a welding site 46 which spans the firing pad 36 and GE body 18 assemblage. The laser beam L can be aimed at the firing pad 36 at or almost at an orthogonal angle relative to the sparking surface 38 (as illustrated in FIG. 3), or it can be aimed at a non-orthogonal angle. The PFO assembly 44 can guide the laser beam L over one or more path(s) that produce a laser weld or molten bond 48 located inboard of a peripheral edge P of the firing pad 36, that produce a weld located along the peripheral edge P (i.e., a seam weld), or that produce a weld with segments located both inboard and outboard of the peripheral edge P such that they are carried over onto the GE body 18, to cite a few possibilities. These welds or molten bonds may be continuous or discontinuous in nature. This step attaches the firing pad 36 to the GE body 18 via laser beam welding. FIG. 4 shows an example of a laser weld or weldment 48 resulting from the first laser beam. In this example, the weld 48 is an annular key-hole laser weld and is formed inboard of the peripheral edge P by laser energy that penetrates transversely through a thickness of the firing pad 36, past a surface-to-surface interface I, and into the GE body 18. In different examples, the weld 48 is located along or follows the peripheral edge P (i.e., a seam weld) or it extends back and forth across the peripheral edge P, as opposed to being located completely inboard of it. At certain portions of the weld 48, the weld can contain a mixture of materials of the firing pad 36 and of the GE body 18. The laser beam's point of entry into the firing pad 36 can be at the sparking surface 38, at its peripheral edge P or, in other examples, on the axially facing surface 26 of the ground electrode. It should be noted that the present spark plug and manufacturing method are not limited to any particular type of weld or weld arrangement.

Figure 5:
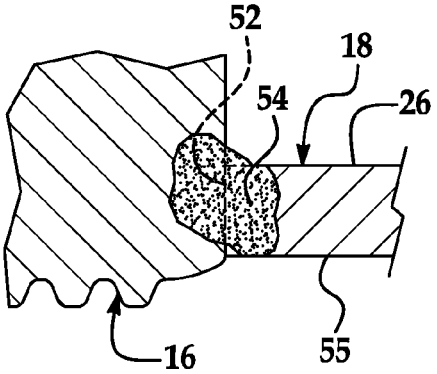
FIG. 5 is a sectional view of an exemplary attachment between a ground electrode body and a metallic shell, and is also rotated with respect to FIG. 3.

Further, using the PFO assembly 44 to perform the second laser beam weld, the laser beam L' is emitted in a second direction generally at a welding site or interfacial region 50 between the GE body 18 and metallic shell 16. In particular, the laser beam L' can be aimed at an edge line of a surface-to-surface interface 52 between the GE body 18 and the metallic shell 16. The PFO assembly 44 can guide the laser beam L' over one or more path(s) that produce a single continuous weld along the extent of the edge line, can guide the laser beam to produce a stitching or criss-crossing weld pattern with individual and discrete weld segments at the edge line, or can guide the laser beam to produce another weld at the interfacial region 50. As before, this step attaches the GE body 18 to the metallic shell 16 via laser beam welding. FIG. 5 shows an example of a solidified weldment or weld 54 resulting from the second laser beam weld. In this example, the weld 54 is also a key-hole weld and begins at the edge line of the surface-to-surface interface 52 and penetrates into the GE body 18 and into the metallic shell 16. The weld 54 can penetrate into the GE body 18 to a depth that is almost equal, or equal, to the thickness of the GE body. This example penetration is depicted in FIG. 5 where the weld 54 spans to an outer surface 55 of the GE body; indeed, in some instances, the weld may even be visible when viewed at the outer surface. It has been found that penetrations to these depths help ensure proper retention and weld strength between the GE body 18 and the metallic shell 16. And like the weld 48, the weld 54 can contain a mixture of materials of the GE body 18 and the metallic shell 16.

When forming the first and second laser beam welds, the spark plug 10 can be positioned and oriented so that the inner side or inner surface 26 of the GE body 18 is exposed to and confronts the delivery head 42 and the emitted laser beams L, L'. This way the welding sites 46, 50 are exposed and accessible for laser welding by a single laser welding apparatus. This is depicted in FIG. 3, where the GE body 18 is shown in an unfinished state before it is bent to its final L- or J-shape (FIG. 1). Indeed, in this embodiment the first and second laser beam welds are performed before the step of pre-bending or final bending the GE body 18 into position so that the firing tip 24 is aligned with the firing pad 36. Moreover, the first and second laser beam welds can be set with different parameters relative to each other that are suitable for the different welds that are being created. The welding parameters may be dependent upon, among other factors, the size, shape, thickness and material of the firing pad 36; the size, shape, thickness and material of the GE body 18; and the size, thickness and material of the wall of the metallic shell 16, and the presence and nature of any already-formed resistance welds, tack welds, etc. In one embodiment of the manufacturing method, the welding parameters (e.g., the intensity or energy of the laser) are adjusted or modified during the welding process so that an energy or intensity of the second laser beam L' which strikes the welding site 50 is greater than the energy or intensity of the first laser beam L which strikes the welding site 46. Typically, more energy or intensity is needed to melt precious metal than nickel, however, in this particular embodiment the laser beam L' needs to penetrate to a depth that is several times deeper (e.g., five times deeper) than that of laser beam L. The increased weld depth results in a much larger weld pool volume, which can add to a "heat-sink" effect already created by the relatively large mass of the metallic shell. In other embodiments or implementations, the laser beam L may require a greater energy or intensity than laser beam L', depending on the application. Adjustment of such welding parameters allows the present method to create customized welds for both welding sites while still using a single laser welding apparatus 40.

The welds 48, 54 can be produced via different laser welding types and techniques. In one example, a fiber laser welder can be used, as well as other laser welders like those that use Nd:YAG, $CO_2$, diode, disk, and hybrid laser equipment, with or without shielding gas (e.g., argon) in order to protect the molten weld pool. In the fiber laser example, the fiber laser emits a relatively concentrated and high energy density beam that can create a key-hole weld 48, 54; other laser beams can also produce a suitably concentrated and high energy density beam and resulting key-hole or non-keyhole weld. In one example of a key-hole weld, the laser beam L melts—and in some cases vaporizes—the materials of the firing pad 36 and of the GE body 18 in the area where the laser beam directly strikes them. A temporary cavity is created as a result, and the temporary cavity is quickly filled mostly, and in some cases entirely, by the adjacent and immediately surrounding material which melts in response to the thermal energy of the laser beam L and flows into the cavity. The laser beams L, L' can be non-pulsed or continuous wave beams, pulsed beams, or some other type. It should be recognized that non-keyhole welds formed from non-fiber lasers may be used at either weld location, as the present method is not so limited.

The first and second laser beam welds can be in addition to previously-performed resistance welds. For instance, the firing pad 36 can be preliminarily attached to the GE body 18 via a tack or resistance weld that serves to temporarily hold and retain the pad in place until the more permanent first laser beam weld is performed. Similarly, the GE body 18 can be preliminarily attached to the metallic shell 16 via a tack or resistance weld that again serves to temporarily hold and retain the components in place until the more permanent second laser beam weld is performed. In these cases, the laser beam welds could be executed physically through the existing resistance weld, and could reinforce and augment the attachment between the components. Or, the laser beam could be executed away from the existing resistance weld. The laser beam welds may also improve heat transfer and removal between the components compared to a resistance weld because the resulting laser weldment may be a more solid and monolithic body through which heat can more readily migrate. And while resistance welding alone provides suitable retention in many cases, it has been found that a GE body of Inconel® alloy 601 material, particularly one that is copper-cored, does not always provide retention to a metallic shell to the extent desired in some instances. Therefore, a supplemental laser beam weld may provide suitable retention in these cases.

Lastly, due to its design and construction—particularly its thinness—the firing pad 36 facilitates the formation of the first and second laser welds with a single laser welding machine and apparatus. That is to say, the laser beam L can be aimed more directly and orthogonally at the sparking surface 38 compared to previously-known seam welds because it is intended for the laser beam L to penetrate completely through the thin firing pad 36, as opposed to having to circumferentially follow the periphery of the firing pad which usually requires some type of non-orthogonal angle of incidence in order for the laser beam to properly impinge or strike the periphery. Once the laser beam L has completed the weld 48 through the thin firing pad 36, which is preferable but not mandatory, the laser beam welder 40 may emit another laser beam L' at welding site 50, as already described. It is not necessary that weld 48 be formed before weld 54; it should be appreciated that the designations "first" and "second" weld do not denote a sequential order, as those terms are just used to distinguish one weld from the other. In many instances, weld 54 could be formed before weld 48.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method of manufacturing a spark plug, the method comprising the steps of:

providing a firing pad, a ground electrode, and a metallic shell;

directing a first laser beam from a laser beam welder to a first welding site that is at or near an interface between the firing pad and the ground electrode and attaching the firing pad to the ground electrode with a first laser weld; and directing a second beam from the laser beam welder to a second welding site that is at or near an interface between the ground electrode and the metallic shell and attaching the ground electrode to the metallic shell with a second laser weld, wherein the first laser beam and the second laser beam are both emitted using the same laser beam welder.

2. The method as set forth in claim 1, wherein the firing pad is a thin firing pad made of a precious metal material, and the method further comprises attaching the thin firing pad to the ground electrode with the first laser weld which extends from a sparking surface of the firing pad, through the thickness of the firing pad, across the interface between the firing pad and the ground electrode, and into a body of the ground electrode.

3. The method as set forth in claim 1, wherein the firing pad is a thin firing pad made of a precious metal material, and the method further comprises attaching the thin firing pad to the ground electrode with the first laser weld which is an annular weld formed inboard of a peripheral edge P of the firing pad.

4. The method as set forth in claim 1, wherein the laser beam welder includes a high energy density fiber laser, and the method further comprises attaching the firing pad to the ground electrode with the first laser weld which is a key-hole laser weld that initially starts as a temporary cavity and is then filled in with molten material from at least one of the firing pad or the ground electrode that flows into and solidifies in the temporary cavity.

5. The method as set forth in claim 1, wherein the ground electrode is made of a nickel-based material with greater than approximately 20 wt % chromium (Cr), and the method further comprises attaching the ground electrode to the metallic shell with the second laser weld which penetrates into the ground electrode and extends to an outer surface of the ground electrode.

6. The method as set forth in claim 1, wherein the ground electrode is made of a nickel-based material, and the method further comprises attaching the ground electrode to the metallic shell with the second laser weld which includes a plurality of weld segments that extend back and forth across the interface between the ground electrode and the metallic shell.

7. The method as set forth in claim 1, wherein the laser beam welder includes a high energy density fiber laser, and the method further comprises attaching the ground electrode to the metallic shell with the second laser weld which is a key-hole laser weld that initially starts as a temporary cavity and is then filled in with molten material from at least one of the ground electrode or the metallic shell that flows into and solidifies in the temporary cavity.

8. The method as set forth in claim 1, wherein the laser beam welder includes a programmable focusing optic (PFO) assembly, and the method further comprises using the PFO assembly to direct the first laser beam to the first welding site to create the first laser weld and using the PFO assembly to direct the second laser beam to the second welding site to create the second laser weld.

9. The method as set forth in claim 8, wherein the firing pad, the ground electrode, and the metallic shell generally remain stationary while the PFO assembly changes the direction of the laser beam from one of the first or second welding sites to the other of the first or second welding sites.

10. The method as set forth in claim 8, wherein the method further comprises using the PFO assembly to direct the first laser beam to the first welding site at an orthogonal angle and using the PFO assembly to direct the second laser beam to the second welding site at a non-orthogonal angle.

11. The method as set forth in claim 1, wherein the method further comprises directing the first laser beam to the first welding site and attaching the firing pad to the ground electrode with a first laser weld formed according to a first laser intensity or energy, and directing the second laser beam to the second welding site and attaching the ground electrode to the metallic shell with a second laser weld formed according to a second laser intensity or energy, and the second laser intensity or energy is greater than the first laser intensity or energy.

12. The method as set forth in claim 1, further comprising:

resistance welding the firing pad to the ground electrode prior to applying the first laser beam, and then reinforcing the resistance weld by directing the first laser beam through at least a portion of the resistance weld.

13. The method as set forth in claim 1, wherein the metallic shell and the ground electrode are oriented relative to the laser beam welder so that an inner surface of the ground electrode confronts the laser beam welder while the first and second laser beams are applied, and the first and second laser beams are applied when the ground electrode is in an unfinished state before a bending process is carried out to the ground electrode.

14. A spark plug, comprising:

a metallic shell having an axial bore;

an insulator having an axial bore and being disposed at least partially within the axial bore of the metallic shell;

a center electrode being disposed at least partially within the axial bore of the insulator;

a ground electrode being attached to the metallic shell; and a firing pad made of a precious metal material being attached to the ground electrode, wherein an attachment between the firing pad and the ground electrode includes a first key-hole weld and an attachment between the ground electrode and the metallic shell includes a second key-hole weld.

15. The spark plug as set forth in claim 14, wherein the firing pad is a thin firing pad with a greatest width dimension across a sparking surface that is at least several times larger than a greatest thickness dimension through the firing pad.

16. The spark plug as set forth in claim 14, wherein the first key-hole weld comprises solidified material of the firing pad and of the ground electrode that, amid formation of the first key-hole weld, was driven into a temporary cavity created by vaporization via impingement of a first laser beam emitted to produce the first key-hole weld, and the second key-hole weld comprises solidified material of the ground electrode and of the metallic shell that, amid formation of the second key-hole weld, was driven into a temporary cavity created by vaporization via impingement of a second laser beam emitted to produce the second key-hole weld.

17. The spark plug as set forth in claim 14, wherein at least a portion of the first key-hole weld extends from a sparking surface of the firing pad and penetrates entirely through a thickness of the firing pad, penetrates past a surface-to-surface interface between the firing pad and the ground electrode, and penetrates into the ground electrode.

18. The spark plug as set forth in claim 14, wherein at least a portion of the second key-hole weld extends from an inner surface of the ground electrode and penetrates radially through a surface-to-surface interface between the ground electrode and the metallic shell.

19. The spark plug as set forth in claim 14, wherein the second key-hole weld includes a stitch weld pattern with individual and discrete key-hole welds at the attachment between the ground electrode and the metallic shell.

20. The spark plug as set forth in claim 14, wherein the attachment between the firing pad and the ground electrode includes a first resistance weld, and the attachment between the ground electrode and the metallic shell includes a second resistance weld.

* * * * *